US010139091B2

(12) United States Patent
Smitt et al.

(10) Patent No.: US 10,139,091 B2
(45) Date of Patent: Nov. 27, 2018

(54) LED LAMP WITH REARWARD EXTENDING HEATSINK

(71) Applicant: SORAA, INC., Fremont, CA (US)

(72) Inventors: Willem Smitt, Fremont, CA (US); Dave Pearson, Fremont, CA (US); Denis Schlegov, Fremont, CA (US)

(73) Assignee: Soraa, Inc., Fremont, CA (US)

( * ) Notice: Subject to any disclaimer, the term of this patent is extended or adjusted under 35 U.S.C. 154(b) by 142 days.

(21) Appl. No.: 15/047,604

(22) Filed: Feb. 18, 2016

(65) Prior Publication Data

US 2016/0238229 A1 Aug. 18, 2016

Related U.S. Application Data

(60) Provisional application No. 62/117,826, filed on Feb. 18, 2015.

(51) Int. Cl.

| | |
|---|---|
| ***F21V 23/06*** | (2006.01) |
| ***F21S 8/06*** | (2006.01) |
| ***F21V 29/77*** | (2015.01) |
| ***F21K 9/237*** | (2016.01) |
| *F21Y 115/10* | (2016.01) |

(52) U.S. Cl.

CPC ..... *F21V 23/06* (2013.01); *F21K 9/237* (2016.08); *F21S 8/06* (2013.01); *F21V 29/773* (2015.01); *F21Y 2115/10* (2016.08)

(58) Field of Classification Search

CPC ..... F21V 23/06; F21V 29/773; F21K 9/237; F21S 8/06

See application file for complete search history.

(56) References Cited

U.S. PATENT DOCUMENTS

2010/0072921 A1* 3/2010 Weatherley ..... F21K 9/00 315/297

* cited by examiner

*Primary Examiner* — Anne Hines

(74) *Attorney, Agent, or Firm* — FisherBroyles LLP

(57) ABSTRACT

A lamp having a front and rear orientation, comprising: (a) a body containing at least one light emitting diode (LED); (b) an electrical connector for operatively providing power to said LED, said electrical connector being rearward of said body and defining a connection plane between said electrical connector and said body, said electrical connector being configured for electrical connection to an electrical interface; and (c) at least one heat sink in thermal communication with at least one of said LED or said driver, said at least one heat sink having a rearward portion extending rearward from said connection plane and enveloping at least a portion of said electrical connector.

17 Claims, 9 Drawing Sheets

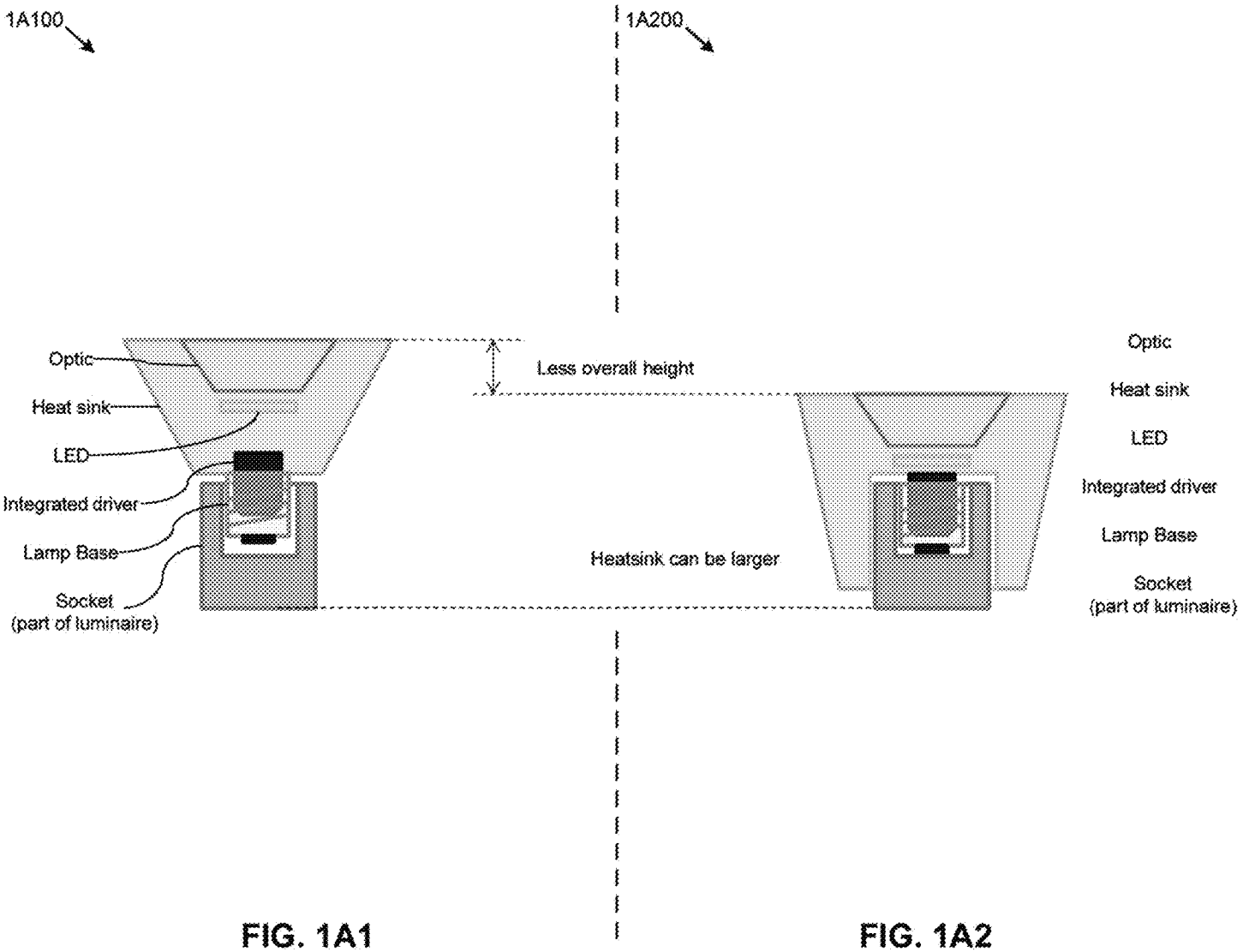
FIG. 1A2
FIG. 1A1

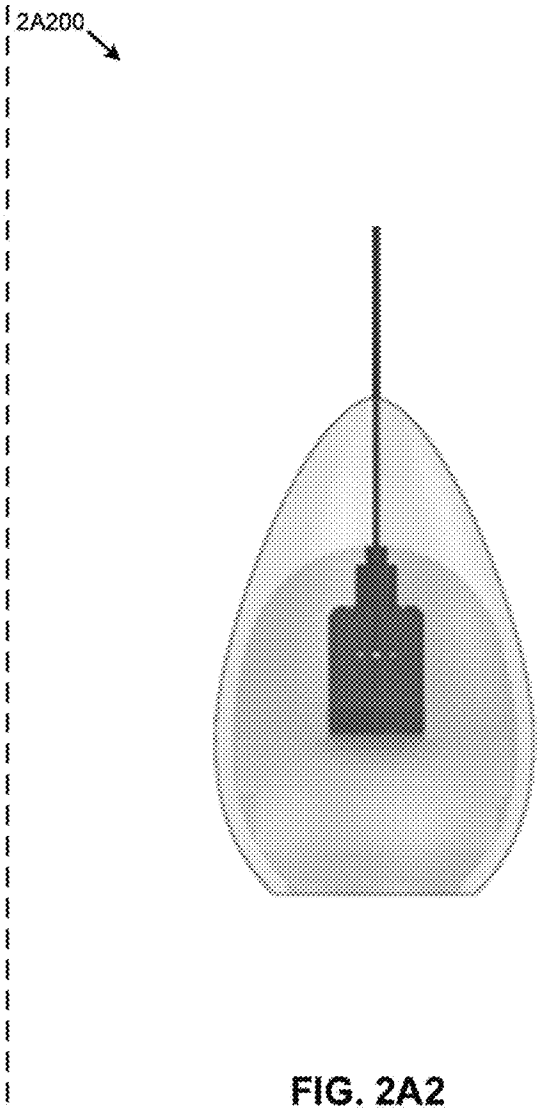
FIG. 2A2
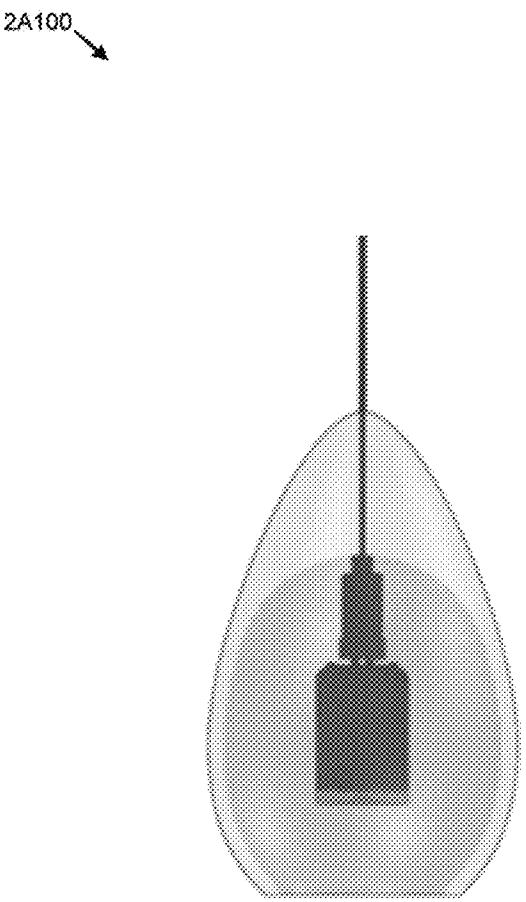
FIG. 2A1

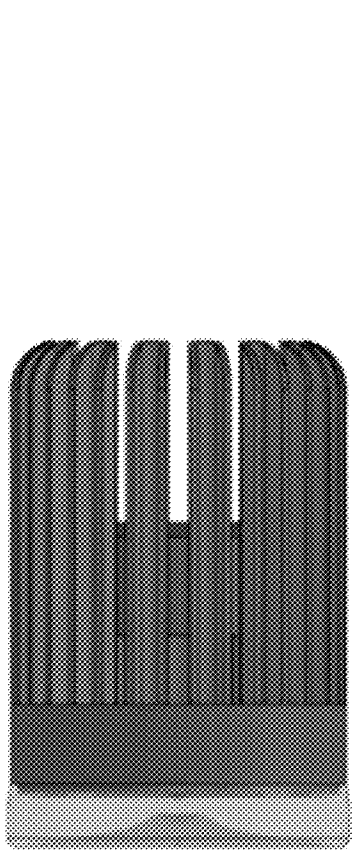
FIG. 3A2
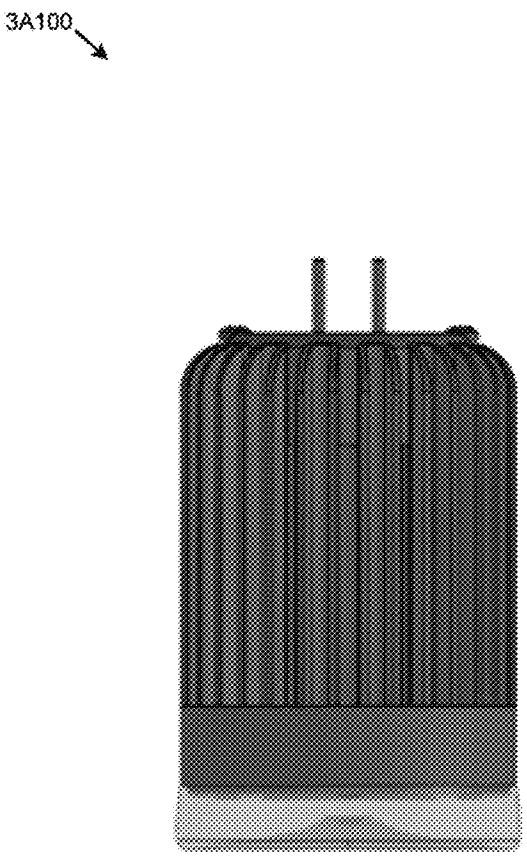
FIG. 3A1

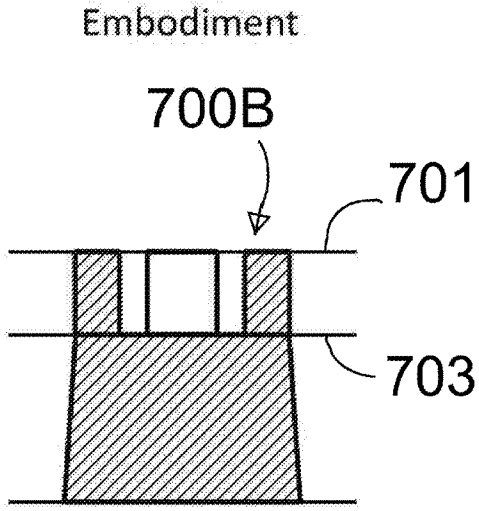
FIG. 7B
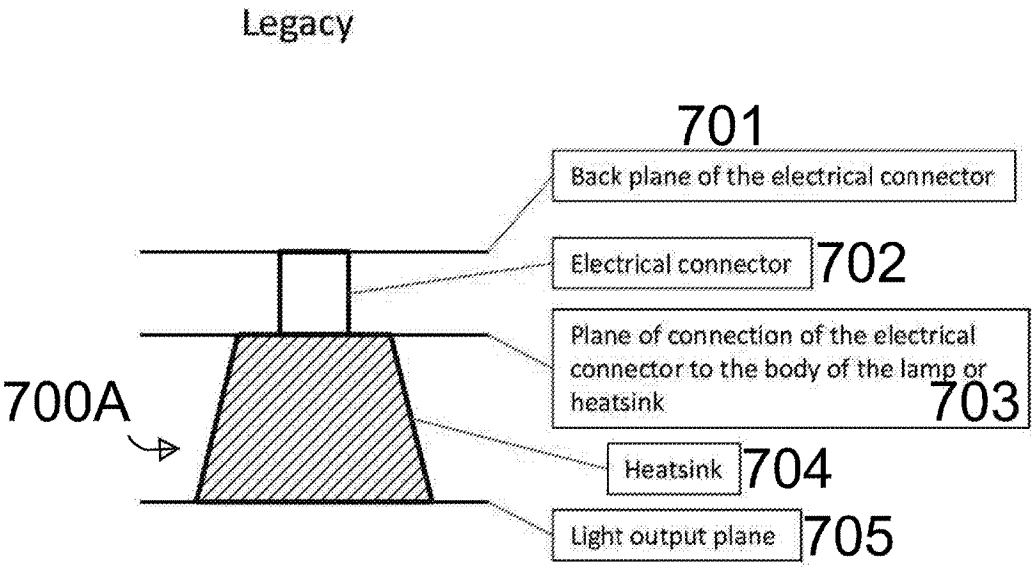
FIG. 7A
FIG. 7

Embodiment variations
FIG. 8A
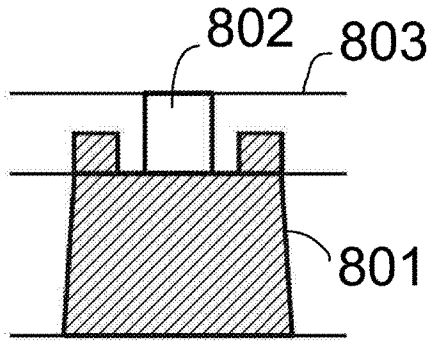
FIG. 8B
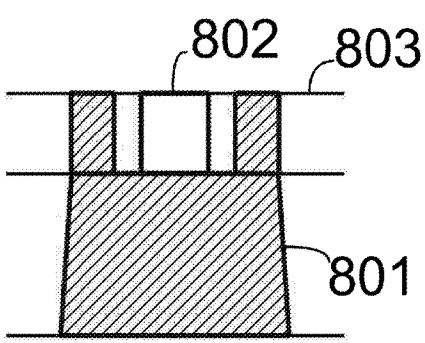
FIG. 8C
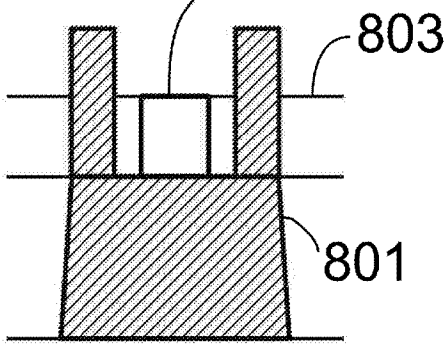
Depending on the embodiment, the heatsink may enclose a fraction of the electrical connector, or its entirety. It may extend beyond the back plane of the electrical connector
FIG. 8

LED LAMP WITH REARWARD EXTENDING HEATSINK

FIELD

This disclosure relates to the field of illumination products and more particularly to techniques for designing an LED lamp electrical connector disposed within a heatsink cavity.

BACKGROUND

Use of LED lamps in retrofit and other illumination product settings has been on the increase. Lighting applications that have traditionally deployed incandescent lamps are now suited for retrofit placement and/or design-in of LED lamps. LED lamps are often accompanied with a heatsink that is designed to distribute heat away from the light-emitting components that can get hot during normal operation. Unfortunately, some applications are demanding with regard to the quantity and shape of any assembly (e.g., LED emitter, heatsink, mating hardware, electrical connector, etc.). In some cases LED lamps cannot be retrofitted with or into conventional electrical connectors simply due to the shape, size and configuration of the LED heatsink. More particularly, many applications have height requirements that preclude use of conventional LED heatsink mating. What is needed is a technique or techniques to produce an LED lamp electrical connector that is disposed within a heatsink cavity. Often the configuration results in better performance thanks to a shape-optimized heatsink and often the configuration results in a shorter overall length of the assembly (e.g., the configuration when the lamp is mounted for use in the intended application).

Legacy approaches are deficient, at least to the extent that they fail to achieve the advantages and/or capabilities of the herein-disclosed techniques for LED lamp electrical connector disposed within a heatsink cavity. Therefore, there is a need for improvements.

SUMMARY

The present disclosure provides an improved method, system, and computer program product suited to address the aforementioned issues with legacy approaches. More specifically, the present disclosure provides a detailed description of techniques used in methods, systems, and computer program products for LED lamp electrical connector disposed within a heatsink cavity. The claimed embodiments address the problem of legacy electrical connector configurations. More specifically, some claims are directed to approaches for reconfiguring the heatsink to accept at least a portion of the lamp electrical connector into a cavity within the heatsink, which claims advance the technical fields for addressing the problem of legacy electrical connector configurations together with a compatible lamp and heatsink consumes too much physical space, as well as advancing peripheral technical fields. Some claims improve the functioning of multiple systems within the disclosed environments.

In a first aspect, apparatus used in a lighting systems are provided, the apparatus comprising an electrical connector member, at least a portion of which is electrically an LED emitter; and a heatsink thermally coupled to the LED emitter, wherein the heatsink at least partially surrounds the electrical connector member.

Further details of aspects, objectives, and advantages of the disclosure are described below and in the detailed description, drawings, and claims. Both the foregoing general description of the background and the following detailed description are exemplary and explanatory, and are not intended to be limiting as to the scope of the claims.

BRIEF DESCRIPTION OF THE DRAWINGS

The drawings described below are for illustration purposes only. The drawings are not intended to limit the scope of the present disclosure.

FIG. 1A1 compares a stacking electrical connector with a LED lamp electrical connector disposed within heatsink cavity.

FIG. 1A2 exemplifies a fold-around heatsink with an LED lamp electrical connector disposed within the heatsink cavity, according to an embodiment.

FIG. 2A1 compares a hanging stacking electrical connector situated within a pendant luminaire.

FIG. 2A2 exemplifies a hanging fold-around heatsink situated within a pendant luminaire, according to an embodiment.

FIG. 3A1 exemplifies a electrical connector-in-heatsink configuration.

FIG. 3A2 exemplifies a electrical connector-recessed-in-heatsink, according to some embodiments.

FIG. 7A and 7B show a legacy/convention lamp compared to an embodiment of the present invention.

FIGS. 8A-8C show various embodiments of the lamp/heatsink of the present invention.

DETAILED DESCRIPTION

Figure 4C:
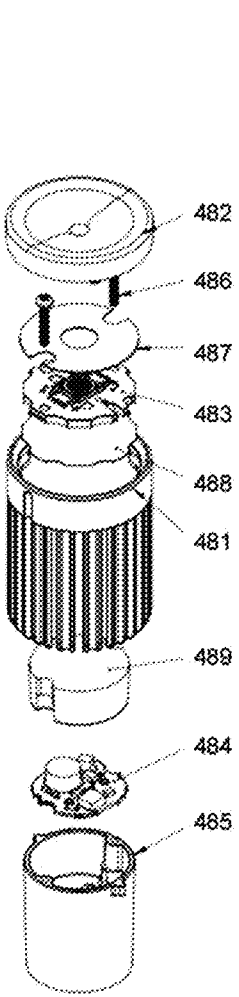
FIG. 4C is an exploded view of a LED lamp electrical connector disposed within a heatsink cavity, according to some embodiments.

Some embodiments of the present disclosure address the problem of legacy electrical connector configurations where a compatible lamp and heatsink consumes too much physical space. Some embodiments are directed to approaches for reconfiguring the heatsink to accept at least a portion of the lamp electrical connector into a cavity within the heatsink. More particularly, disclosed herein and in the accompanying figures are exemplary environments, methods, and systems for designing LED lamp electrical connector disposed within a heatsink cavity.

LED lighting systems are everywhere, yet many lighting applications have height requirements that preclude use of conventional LED heatsink mating. What is needed is a technique or techniques to produce an LED lamp electrical connector that is disposed within a heatsink cavity.

Some of the terms used in this description are defined below for easy reference. The presented terms and their respective definitions are not rigidly restricted to these definitions—a term may be further defined by the term's use within this disclosure.

The term "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

As used in this application and the appended claims, the term "or" is intended to mean an inclusive "or" rather than an exclusive "or". That is, unless specified otherwise, or is clear from the context, "X employs A or B" is intended to mean any of the natural inclusive permutations. That is, if X employs A, X employs B, or X employs both A and B, then "X employs A or B" is satisfied under any of the foregoing instances.

The articles "a" and "an" as used in this application and the appended claims should generally be construed to mean "one or more" unless specified otherwise or is clear from the context to be directed to a singular form.

Reference is now made in detail to certain embodiments. The disclosed embodiments are not intended to be limiting of the claims.

FIG. 1A1 compares a stacking electrical connector 1A100 with a LED lamp electrical connector disposed within heatsink cavity.

As shown in FIG. 1A1, the stacking electrical connector comprises a heatsink that mates against a lamp base. In this configuration, the height of the assembly is at least the combination of the height of the lamp base plus the height of the heatsink. In some cases, the resulting height is too high for a particular application, thus exemplifying the need for improvements. One such improvement involves design of a heatsink that folds around a electrical connector so as to reduce the total height of the combination of the height of the lamp base plus the height of the heatsink.

FIG. 1A2 exemplifies a fold-around heatsink 1A200 with an LED lamp electrical connector disposed within the heatsink cavity.

As shown in FIG. 1A2, the fold-around heatsink comprises a heatsink that folds-around or wraps-around one or more components of a lamp (e.g., a electrical connector component, a driver housing, a lamp base component). The driver or drivers can be implemented using any known-in-the art technique. In particular, drivers are configured or configurable to accommodate driver a range of different voltages (e.g., 12V, 100V, 120V, 230V, 277V, etc.).

FIG. 2A1 compares a hanging stacking electrical connector 2A100 situated within a pendant luminaire.

As shown in FIG. 2A1, the hanging stacking electrical connector comprises a legacy stacking electrical connector 1A100. As indicated, the light-emitting surfaces of the LED lamp are disposed deeply downward in the pendant. Use of such a legacy stacking electrical connector 1A100 sometimes has the result that an LED lamp cannot be retrofitted. What is needed is a way to bring the light-emitting surfaces of the LED to the same height as were the light-emitting surfaces of the legacy lamp being replaced. Such a configuration is given in FIG. 2A2.

FIG. 2A2 exemplifies a hanging fold-around heatsink 2A200 situated within a pendant luminaire.

As shown in FIG. 2A2, the hanging fold-around heatsink comprises a wrap-around or fold-around heatsink. Since the electrical connector is recessed into the cavity of the shown heatsink, the light-emitting surfaces of the LED are brought to the same height as were the light-emitting surfaces of the legacy lamp being replaced.

FIG. 3A1 exemplifies a electrical connector-in-heatsink 3A100 configuration.

As shown in FIG. 3A1, the electrical connector-in-heatsink includes connector pins that protrude beyond the envelope of the heatsink. Presence of such a protrusion further exacerbates the problem of the height of the assembly. One possible improvement is to recess the connector (and pins), and to wrap the fins of the heatsink around the connector and pins.

FIG. 3A2 exemplifies a electrical connector-recessed-in-heatsink 3A200.

As shown in FIG. 3A2, the electrical connector-recessed-in-heatsink is in a configuration that reduces the height of the assembly by more than 50%.

Figure 4B:
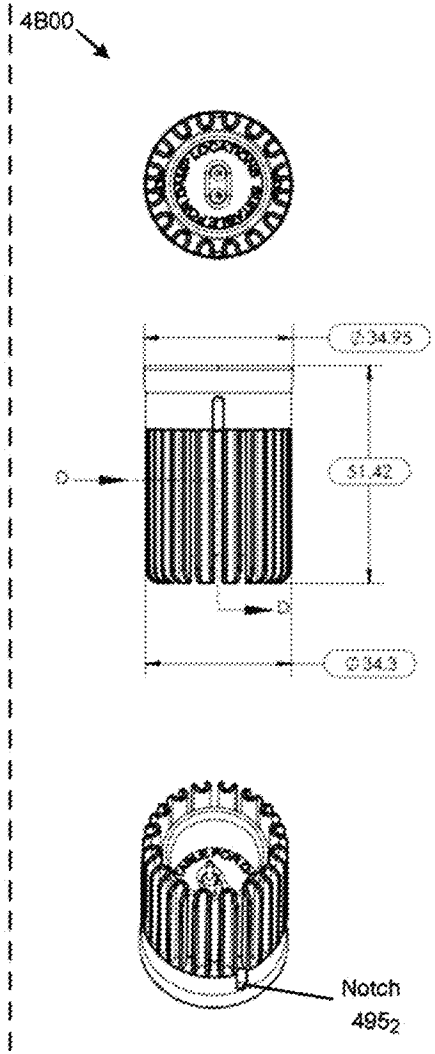
FIG. 4B is a connector-side sectional view of a LED lamp electrical connector disposed within a heatsink cavity, according to some embodiments.
Figure 4A:
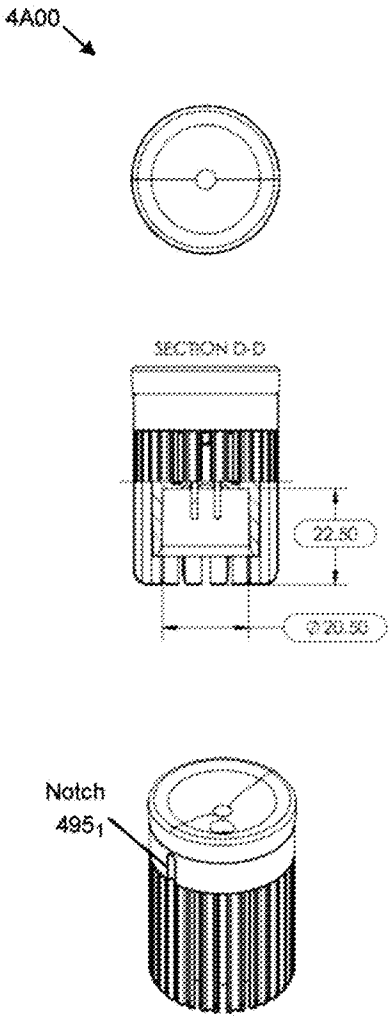
FIG. 4A is an emitter-side sectional view of a LED lamp electrical connector disposed within a heatsink cavity, according to some embodiments.

FIG. 4A is an emitter-side sectional view 4A00 of a LED lamp electrical connector disposed within a heatsink cavity.

As shown in FIG. 4A, the emitter-side sectional view includes a notches 495 (see shown notch $\mathbf{495}_1$). The notch is also visible on the connector-side sectional view 4B00 (see shown notch $\mathbf{495}_2$). In cases when the heatsink folds around the lamp base, notches facilitate alignment of the lamp base pins to the electrical connector terminals. The notches are aligned with the pinch for easier insertion.

FIG. 4B is a connector-side sectional view 4B00 of a LED lamp electrical connector disposed within a heatsink cavity.

FIG. 4C is an exploded view 4C00 of a LED lamp electrical connector disposed within a heatsink cavity.

The exploded view includes the show components. Item 485 serves the purpose of easier insertion through terminal-to pin alignment. The item 485 includes an aspect of a conical shape and operates guide while installing the lamp. The shape and protrusions directs the pins to the terminals.

Figure 5C:
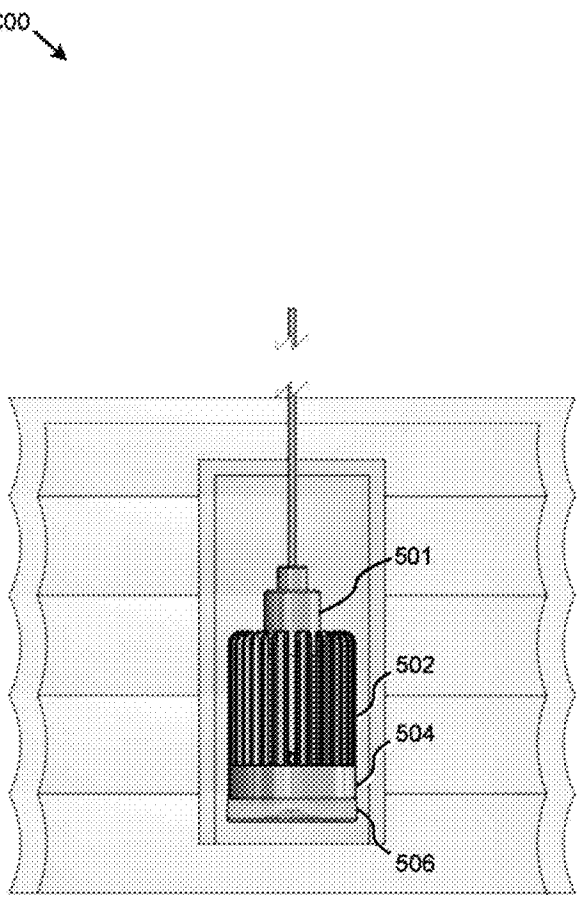
FIG. 5C depicts a wall alcove for receiving a luminaire connected to a LED lamp electrical connector disposed within a heatsink cavity, according to some embodiments.
Figure 5B:
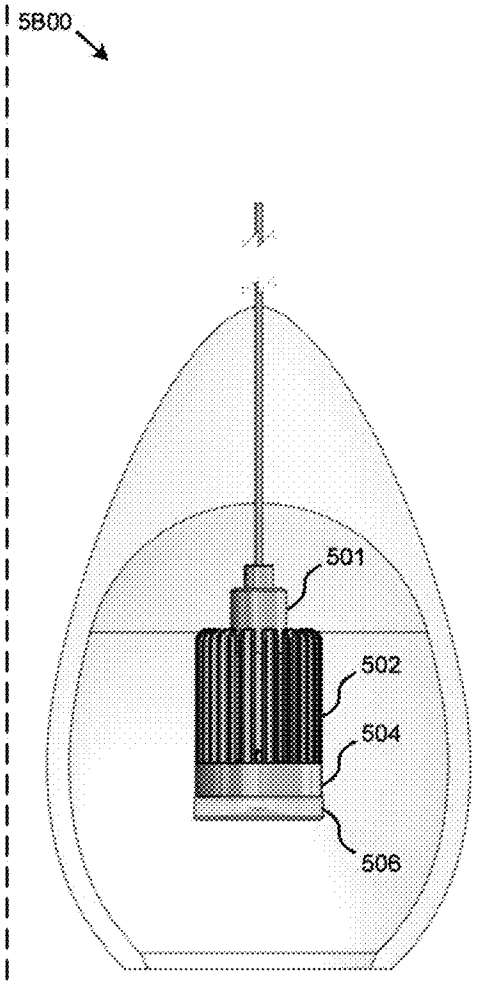
FIG. 5B depicts an assembly including a luminaire connected to a LED lamp electrical connector disposed within a heatsink cavity, according to some embodiments.
Figure 5A:
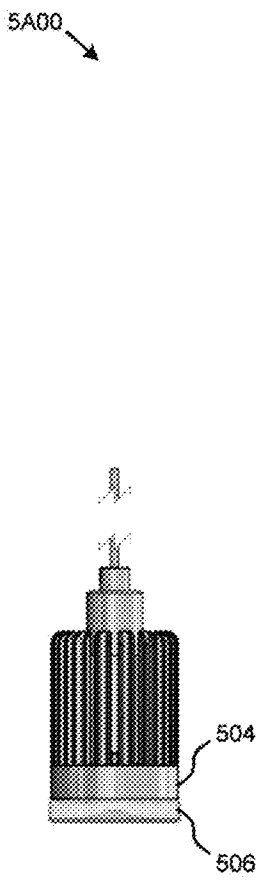
FIG. 5A depicts an assembly including an LED lamp electrical connector disposed within a heatsink cavity, according to some embodiments.

FIG. 5A depicts an assembly 5A00 including an LED lamp electrical connector disposed within a heatsink cavity.

As shown in FIG. 5A, the assembly comprises an apparatus having a electrical connector member 501, at least a portion of which is electrically an LED emitter 504. The apparatus further comprises a heatsink 502 that is thermally coupled to the LED emitter wherein a portion of the heatsink surrounds the electrical connector member. The apparatus shown also has a lens 506.

FIG. 5B depicts an assembly 5B00 including a luminaire connected to a LED lamp electrical connector disposed within a heatsink cavity.

FIG. 5C depicts a wall alcove 5C00 for receiving a luminaire connected to a LED lamp electrical connector disposed within a heatsink cavity.

Any of the constituent components (e.g., component 482, component 486, component 487, component 483, component 488, component 481, component 489, component 484, etc.) can be used to form a sighting system (e.g., a lamp, a luminaire, etc.).

It should be noted that there are alternative ways of implementing the embodiments disclosed herein. Accordingly, the embodiments and examples presented herein are to be considered as illustrative and not restrictive, and the claims are not to be limited to the details given herein, but may be modified within the scope and equivalents thereof.

Figure 6:
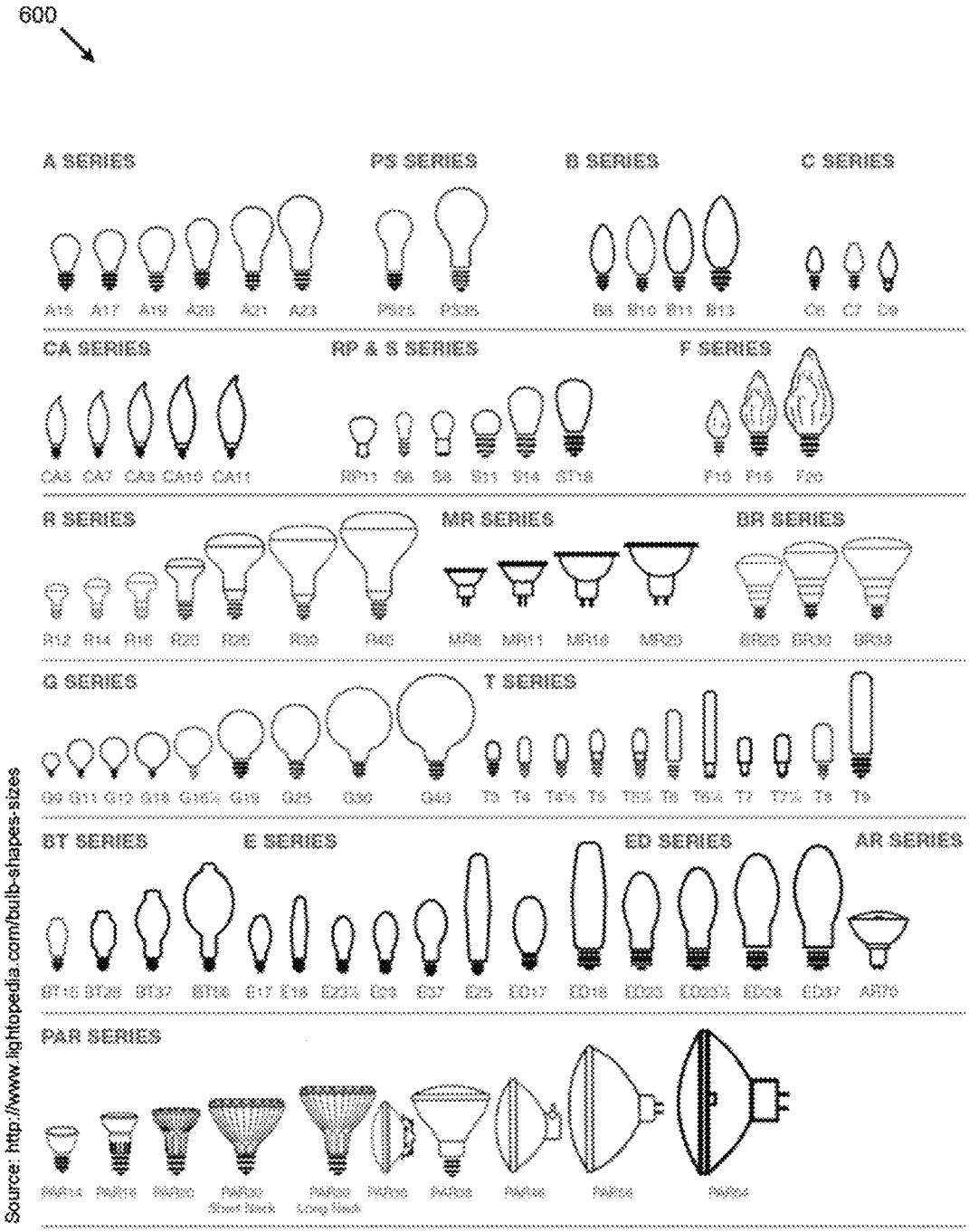
FIG. 6 presents a selection of lamp shapes corresponding to known-in-the-art standards. The aforementioned lamps are selected embodiments of lamps that conform to fit with any one or more of a set of mechanical and electrical standards.

FIG. 6 presents a selection of lamp shapes corresponding to known-in-the-art standards. The aforementioned lamps are selected embodiments of lamps that conform to fit with any one or more of a set of mechanical and electrical standards. Table 1 gives standards (see "Designation") and corresponding characteristics.

Referring to FIG. 7A and 7B, a comparison is shown of a legacy/conventional lamp 700A is compared to an embodiment of the lamp 700B of present invention. Specifically, referring to FIG. 7A, the legacy lamp 700A comprises a backplane 701 of an electric connector 702, the electric connector 702, a plane 703 of the connection between the electrical connector 702 and the heatsink 704, the heatsink 704, and a light output plain 705. Comparing these elements to an embodiment of the lamp 700B of the present invention, differences are clear. Specifically, in this embodiment, the heatsink 704 extends to the backplane 701 of electric connector 702.

Still other embodiments of the present invention are within the scope of the claims. For example, referring to FIGS. 8A-8C, depending upon the embodiment, the heatsink 801 may enclose a fraction of the electrical connector 802 as shown in FIG. 8A, or its entirety as shown in FIG. 8C. The heatsink 801 may even extend beyond the backplane 803 of electrical connector 802 as shown in FIG. 8C.

Figure 9C:
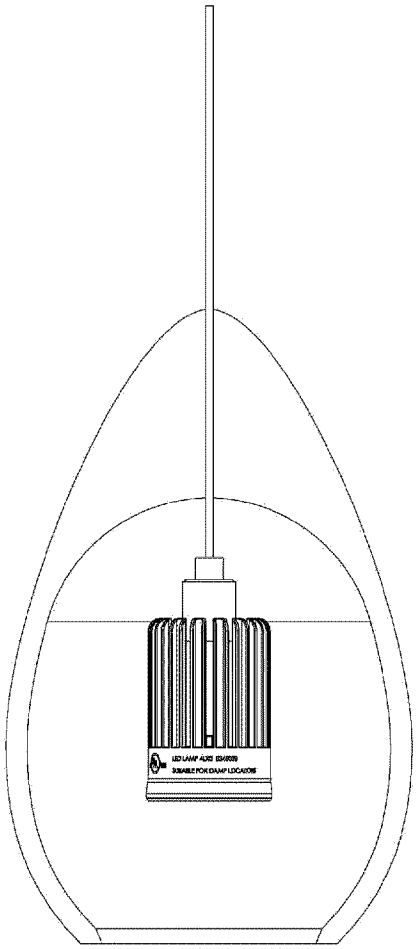
FIGS. 9A-9C show a comparison of the extension of the heatsink of a conventional design versus the heatsink configuration of the present invention.
Figure 9B:
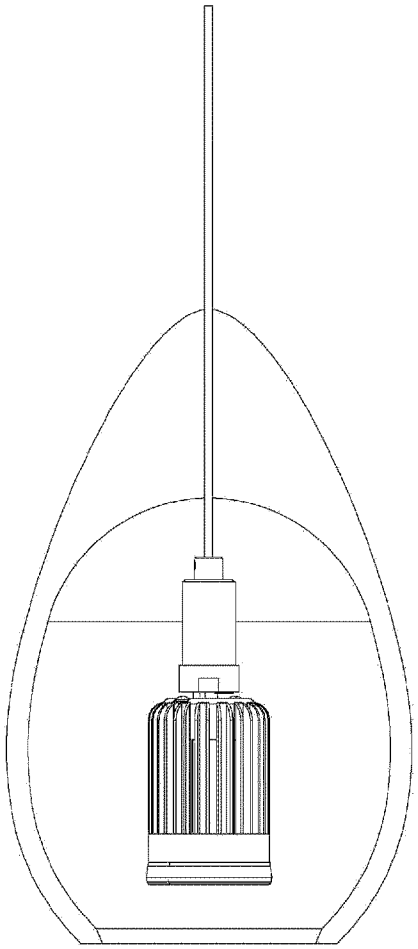
Figure 9A:
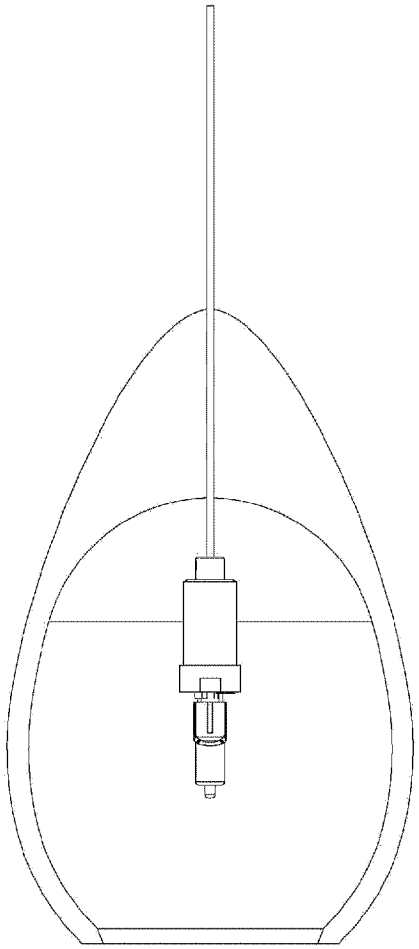

Referring to FIGS. 9A-9C, the advantage of the configuration of the heatsink of the present invention is shown. Specifically, referring to FIG. 9A, an LED light element retrofitted into a conventional lamp is shown. FIG. 9B shows the form factor of such a light element having a conventional heatsink (e.g., the heatsink as shown in FIG. 7A). FIG. 9C shows the reduced form factor by using the heatsink of the present invention (e.g., the heatsinks of FIGS. 8B and 8C).

TABLE 1

| Designation | Base Diameter (crest of thread) | Name | IEC 60061-1 Standard Sheet |
|---|---|---|---|
| E05 | 05 mm | Lilliput Edison Screw (LES) | 7004-25 |
| E10 | 10 mm | Miniature Edison Screw (MES) | 7004-22 |
| E11 | 11 mm | Mini-Candelabra Edison Screw (mini-can) | (7004-06-1) |
| E12 | 12 mm | Candelabra Edison Screw (CES) | 7004-28 |
| E14 | 14 mm | Small Edison Screw (SES) | 7004-23 |
| E17 | 17 mm | Intermediate Edison Screw (IES) | 7004-26 |
| E26 | 26 mm | [Medium] (one-inch) Edison Screw (ES or MES) | 7004-21A-2 |
| E27 | 27 mm | [Medium] Edison Screw (ES) | 7004-21 |
| E29 | 29 mm | [Admedium] Edison Screw (ES) | |
| E39 | 39 mm | Single-contact (Mogul) Giant Edison Screw (GES) | 7004-24-A1 |
| E40 | 40 mm | (Mogul) Giant Edison Screw (GES) | 7004-24 |

Additionally, the base member of a lamp can be of any form factor configured to support electrical connections, which electrical connections can conform to any of a set of types or standards. For example, Table 2 gives standards (see "Type") and corresponding characteristics, including mechanical spacing between a first pin (e.g., a power pin) and a second pin (e.g., a ground pin).

TABLE 2

| Type | Standard | Pin Center to Center | Pin Diameter | Usage |
|---|---|---|---|---|
| G4 | IEC 60061-1 (7004-72) | 4.0 mm | 0.65-0.75 mm | MR11 and other small halogens of 5/10/20 watt and 6/12 volt |
| GU4 | IEC 60061-1 (7004-108) | 4.0 mm | 0.95-1.05 mm | |
| GY4 | IEC 60061-1 (7004-72A) | 4.0 mm | 0.65-0.75 mm | |
| GZ4 | IEC 60061-1 (7004-64) | 4.0 mm | 0.95-1.05 mm | |
| G5 | IEC 60061-1 (7004-52-5) | 5 mm | | T4 and T5 fluorescent tubes |
| G5.3 | IEC 60061-1 (7004-73) | 5.33 mm | 1.47-1.65 mm | |
| G5.3-4.8 | IEC 60061-1 (7004-126-1) | | | |
| GU5.3 | IEC 60061-1 (7004-109) | 5.33 mm | 1.45-1.6 mm | |
| GX5.3 | IEC 60061-1 (7004-73A) | 5.33 mm | 1.45-1.6 mm | MR16 and other small halogens of 20/35/50 watt and 12/24 volt |
| GY5.3 | IEC 60061-1 (7004-73B) | 5.33 mm | | |
| G6.35 | IEC 60061-1 (7004-59) | 6.35 mm | 0.95-1.05 mm | |
| GX6.35 | IEC 60061-1 (7004-59) | 6.35 mm | 0.95-1.05 mm | |
| GY6.35 | IEC 60061-1 (7004-59) | 6.35 mm | 1.2-1.3 mm | Halogen 100 W 120 V |
| GZ6.35 | IEC 60061-1 (7004-59A) | 6.35 mm | 0.95-1.05 mm | |
| G8 | | 8.0 mm | | Halogen 100 W 120 V |
| GY8.6 | | 8.6 mm | | Halogen 100 W 120 V |
| G9 | IEC 60061-1 (7004-129) | 9.0 mm | | Halogen 120 V (US)/230 V (EU) |
| G9.5 | | 9.5 mm | 3.10-3.25 mm | Common for theatre use, several variants |
| GU10 | | 10 mm | | Twist-lock 120/230-volt MR16 halogen lighting of 35/50 watt, since mid-2000s |

TABLE 2-continued

| Type | Standard | Pin Center to Center | Pin Diameter | Usage |
|---|---|---|---|---|
| G12 | | 12.0 mm | 2.35 mm | Used in theatre and single-end metal halide lamps |
| G13 | | 12.7 mm | | T8 and T12 fluorescent tubes |
| G23 | | 23 mm | 2 mm | |
| GU24 | | 24 mm | | Twist-lock for self-ballasted compact fluorescents, since 2000s |
| G38 | | 38 mm | | Mostly used for high-wattage theatre lamps |
| GX53 | | 53 mm | | Twist-lock for puck-shaped under-cabinet compact fluorescents, since 2000s |

The list above is representative and should not be taken to include all the standards or form factors that may be utilized within embodiments described herein. In particular, lamps can also have not-yet-defined shapes and electrical connector types (e.g., mini USB). Embodiments of the present disclosure in the form of lamp applications using not-yet-defined shapes and electrical connector types are reasonable and contemplated.

In the foregoing specification, the disclosure has been described with reference to specific embodiments thereof. It will, however, be evident that various modifications and changes may be made thereto without departing from the broader spirit and scope of the disclosure. For example, the above-described process flows are described with reference to a particular ordering of process actions. However, the ordering of many of the described process actions may be changed without affecting the scope or operation of the disclosure. The specification and drawings are, accordingly, to be regarded in an illustrative sense rather than in a restrictive sense.

What is claimed is:

1. A lamp for replacing a standard light bulb having a standard electrical connector, said lamp having a front and rear orientation and comprising:

a body containing at least one light emitting diode (LED);

an electrical connector for operatively providing power to said LED, said electrical connector being one of an Edison screw-type connector or a pin-type connector, said electrical connector being rearward of said body and defining a connection plane between said electrical connector and said body, said electrical connector being configured for electrical connection to an electrical interface; and at least one heat sink in thermal communication with at least one of said LED or said driver, said at least one heat sink having a rearward portion extending rearward from said connection plane and enveloping at least a portion of said electrical connector.

2. The lamp of claim 1, wherein said rearward portion, envelops said electrical connector.

3. The lamp of claim 2, wherein said electrical connector has a distal end, and said rearward portion extends beyond said distal end.

4. The lamp of claim 1, wherein said rearward portion comprises at least 20% of the mass of said heat sink.

5. The lamp of claim 1, wherein said rearward portion comprises at least 50% of the mass of said heat sink.

6. The lamp of claim 1, wherein said heat sink also comprise a forward portion forward of said rearward portion, wherein the ratio of mass of the rearward portion to said forward portion is at least 1:4.

7. The lamp of claim 6, wherein said ratio is at least 1:2.

8. The lamp of claim 7, wherein said ratio is at least 1:1.

9. The lamp of claim 1, wherein said heat sink also comprise a forward portion forward, of said rearward portion, wherein said LED defines a light plane, wherein said light plane is in said forward portion.

10. The lamp of claim 9, wherein said light plane is in the forward half of said forward portion.

11. The lamp of claim 10, wherein said light plane is in the forward quarter of said forward portion.

12. The lamp of claim 1, wherein said rearward portion defines an opening to receive at least a portion of said electrical interface.

13. The lamp of claim 12, wherein said opening is only slightly larger than the diameter of said electrical interface such that inserting said electrical interface in said opening aligns said electrical connector with said electrical interface.

14. The lamp of claim 1, further comprising driver circuitry for driving said LED and wherein said electrical connector operatively providing power to said LED comprises said electrical connector being electrically connected to said driver circuitry for delivering power to said driver circuitry.

15. The lamp of claim 14, wherein said driver circuitry is at least partially within said electrical connector.

16. The lamp of claim 1, wherein said Edison screw-type electrical connector is selected from Table 1.

17. The lamp of claim 1, wherein said pin-type electrical connector is selected from Table 2.

* * * * *